US005204494A

United States Patent [19]

Meyer et al.

[11] Patent Number: 5,204,494

[45] Date of Patent: Apr. 20, 1993

[54] SUBCALIBER PROJECTILE WITH SABOT

[75] Inventors: Jürgen Meyer, Cologne; Achim Sippel; Heinz-Josef Kruse, both of Ratingen; Siegfried Kessler; Horst Kantner, both of Düsseldorf; Ulrich Theis, Mülheim, all of Fed. Rep. of Germany

[73] Assignee: Rheinmetall GmbH, Düsseldorf, Fed. Rep. of Germany

[21] Appl. No.: 683,959

[22] Filed: Apr. 12, 1991

[30] Foreign Application Priority Data

Apr. 14, 1990 [DE] Fed. Rep. of Germany ..... 4012154

[51] Int. Cl.[5] ..... F42B 14/06

[52] U.S. Cl. ..... 102/521

[58] Field of Search ..... 102/520-523, 102/703

[56] References Cited

U.S. PATENT DOCUMENTS 3,262,391 7/1966 Shober .
4,372,217 2/1983 Kirkendall et al. .
4,901,645 2/1990 Bisping et al. ..... 102/521
5,063,855 11/1991 Diel et al. ..... 102/521

*Primary Examiner*—Harold J. Tudor
*Attorney, Agent, or Firm*—Spencer, Frank & Schneider

[57] ABSTRACT

A subcaliber projectile including a segmented discardable propelling cage sabot which encloses at least a portion of the projectile body and has a common form-locking zone for the transfer of acceleration forces from the propelling cage to the projectile body. The form-locking zone has mating annular grooves and counter grooves on the exterior surface of the projectile body and on the interior surface of the propelling cage, and is subdivided into several form-locking zone regions in which the annular grooves have a different groove spacing that is adapted to the locally occurring shear stresses. These measures enhance simplification of the manufacturing process and result in an improvement of the release of the propelling cage sabot from the projectile body and in an increase in the target impact velocity of the projectile body.

13 Claims, 5 Drawing Sheets

SUBCALIBER PROJECTILE WITH SABOT

BACKGROUND OF THE INVENTION

The present invention relates to a subcaliber kinetic energy projectile provided with a segmented discardable propelling cage sabot which encloses a partial region of the projectile which is provided with annular grooves on its outer surface for form lockingly engaging with annular countergrooves on the interior surface of the sabot.

U.S. Pat. No. 3,859,922 discloses a projectile arrangement which includes grooved teeth as the force transmitting means between a cylindrical propelling cage sabot and a projectile. For this purpose, the projectile or penetrator surface has been worked so that it has a structure of equidistant sawteeth. The inner surface of the propelling cage sabot is provided with corresponding sawtooth-like recesses into which engage the sawteeth of the penetrator surface. The steps of the propelling cage grooves are here slightly larger than those of the corresponding projectile grooves. Moreover, grooves are designed in such a manner that, before firing, the vertical flanks of the sawteeth of the projectile are not in direct contact with the corresponding vertical surfaces of the propelling cage sabot grooves, that small spaces exist between the vertical flank end surfaces which spaces become larger from tooth to tooth in the direction toward the tail. Only the surfaces of the foremost pair of teeth initially are in binding contact with one another. When a shot is fired, the relative deformation of the penetrator material and that of the propelling cage sabot material is intended to produce a successive closing of the spaces between the teeth starting with this foremost pair of teeth and continuing toward the rear teeth. The different sizes of the spaces between the teeth or ribs on the propelling cage sabot are provided to make the force transfer the same for each tooth or rib.

In this propelling cage sabot the force is transmitted only in the axial direction. Such a force transfer arrangement cannot be transferred to dual-flange propelling cage sabots since in the latter the space filled with gas pressure encounters not only axial forces but also radially acting forces, so that the displacement of the propelling cage sabot teeth as disclosed in U.S. Pat. No. 3,859,922 is not possible.

The artillery ammunition disclosed in U.S. Pat. No. 4,469,027 has right-hand and left-hand screw threads for the transmission of force between a propelling cage sabot and a projectile. In one embodiment, these threads are applied to two separate projectile sections. In a second embodiment, these threads are arranged above one another on one projectile section so that a type of herringbone pattern with rhombic projections is formed.

However, such form-locking threads in the sense of screw threads have the drawback that their production increases the notch sensitivity of the penetrator and this adversely influences the penetration process. Moreover, during cutting of a thread it frequently happens that the thread cutter employed goes out of true and, particularly if long threads are cut, pitch errors occur. The resulting inherent stresses generated during the separation of the sabot often cause the individual propelling cage sabot segments to be uncontrollably ejected.

SUMMARY OF THE INVENTION

It is an object of the present invention to improve a subcaliber kinetic energy projectile of the above type which is provided with a segmented discardable propelling cage sabot so that the penetrator manufacturing process is noticeably improved and the penetrator receives the lowest number of disturbance locations, e.g., surface grooves, etc, for the penetration process.

The above object is generally accomplished by the present invention by a projectile arrangement including a subcaliber projectile having a projectile body, a segmented discardable propelling cage sabot which surrounds at least a partial region of the length of the projectile body, and form locking means, disposed in a common form-locking zone extending along at least a portion of the surrounded region of the projectile body, for transferring the acceleration forces from the propelling cage sabot to the projectile body, with the form-locking means including corresponding annular grooves on an exterior surface of the projectile body and on an interior surface of the propelling cage sabot; and wherein: the common form-locking zone is subdivided into at least two form-locking zone regions; and the annular grooves in the at least two form-locking zone regions each have a respectively different groove spacing which is adapted to the locally occurring shear stresses.

According to one embodiment of the invention the groove spacing in a first of the form-locking zone regions is at least 1.5 times as large as the groove spacing in an adjacent second of the form-locking zone regions.

Preferably the propelling cage sabot is a dual flange sabot, the second form-locking zone region extends at least over the longitudinal extent of the rear flange, and the first form-locking region is disposed in front of the second of the form-locking zone regions.

According to a feature of the invention, the common form-locking zone is subdivided into at least three form-locking zone regions with the annular grooves in each of the three form-locking zone regions having respectively different groove spacings which are adapted to the locally occurring shear stresses. Preferably the groove spacing in the third form-locking zone region is greater than the groove spacing in the first form-locking zone region and is disposed in front of the second form locking region and extends to the front of the form-locking zone.

According to a further feature of the invention, the form-locking zone includes at least one smooth region with no annular grooves. This smooth region may be disposed at a tail end of the form-locking zone so that the acceleration forces are transferred between the projectile body and the propelling cage sabot in this region by friction.

According to a further feature of the invention, the height of the grooves and the depths of the associated groove bottoms are different in the respective form-locking zone regions in adaptation to the locally occurring shear stresses.

According to a further embodiment of the invention the annular grooves in one of the form-locking zone regions of the common form-locking zone are spaced at variable distances which are adapted to the occurring shear stress.

Embodiments of the invention will be described below with reference to the drawing figures.

DETAILED DESCRIPTION OF THE PREFERRED EMBODIMENTS

Figure 1:
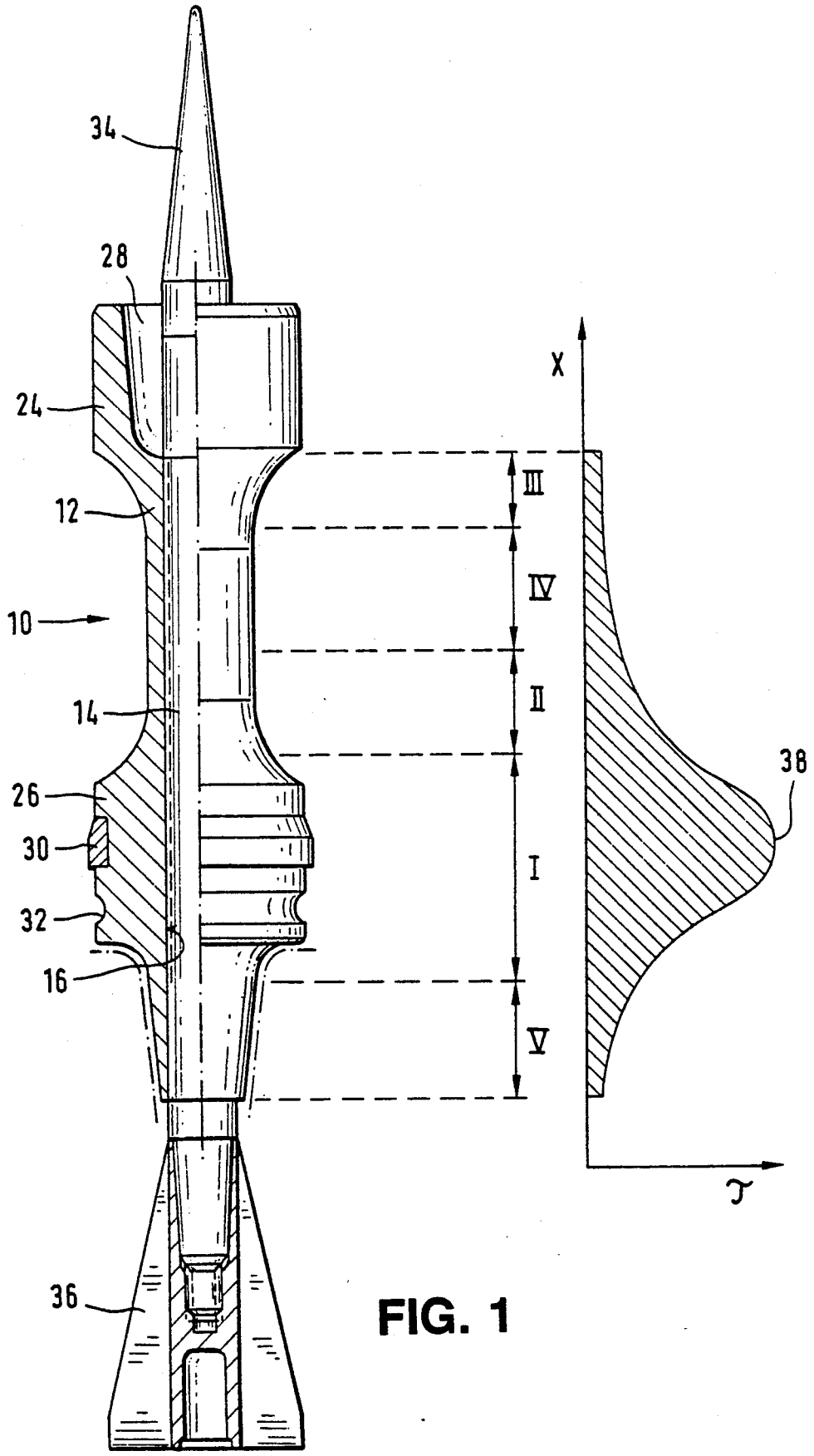
FIG. 1 is an elevational view, partially in section, showing a subcaliber kinetic energy projectile according to the present invention provided with a segmented discardable propelling cage sabot, and the thrust curve which occurs over the length of the sabot.

In FIG. 1, the reference numeral 12 identifies a dual-flange segmented propelling cage sabot which includes a forward guide flange 24 and a rear pressure flange 26, for a very slender, subcaliber, fin-stabilized kinetic energy projectile 10 made of, for example, a tungsten heavy metal alloy. Forward guide flange 24 has an air pocket 28 at its front end surface. In its caliber size circumferential region, the rear pressure flange 26 is provided with a guide and sealing band 30, and a choke groove 32 for fastening a propelling charge casing (not shown) to the sabot. In a known manner the sabot 12 surrounds a longitudinal extending portion of the projectile body or penetrator 14 which is provided with a fin guide mechanism 36 at its rear.

According to the invention, the longitudinal extent of a form-locking zone 16 between the propelling cage sabot 12 and the projectile body 14 is divided into a plurality of form-locking zone regions marked I, II, III, IV, and V in the embodiment of FIG. 1. The thrust curve which develops when projectile 10 is fired is shown over the length X of the form-locking zone 16. The shear stress $\tau$ has its maximum 38 in the region of the rear pressure flange 26 of the sabot 12 and decreases both in the direction of projectile tip 34 up to a forward guide flange 24 and also in the direction of the fin guide mechanism 36. Due to this shear stress curve, it is possible to provide form-locking zone 16 with non-uniform form-locking means which are each adapted to the shear stresses $\tau$ existing in the individual form-locking zone regions I, II, III, IV and V.

Figure 2:
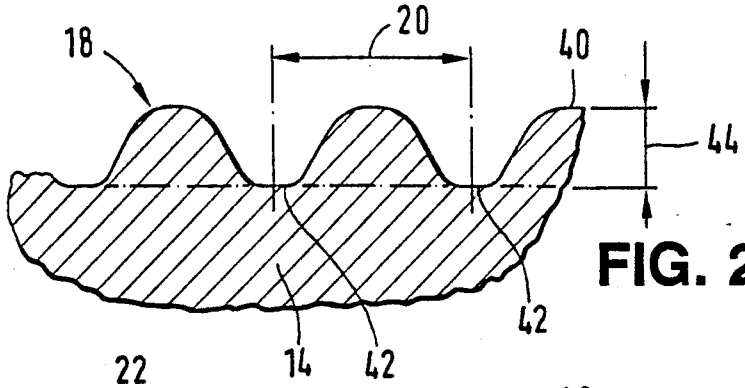
FIG. 2 is a longitudinal sectional view showing a first embodiment of a form-locking zone region between the kinetic energy projectile and the sabot of FIG. 1.

FIG. 2 is a longitudinal sectional view through projectile body 14 and shows one embodiment of a groove profile which is employed according to the invention as a form-locking means in the zone 16. In this embodiment the annular grooves 18 have a uniform and continuous round profile in cross-section. Reference numeral 20 identifies the groove spacing and reference numeral 44 identifies the groove height from the groove bottom 42 to the groove land 40. Annular grooves 18, which are here arranged on projectile body 14 at a spacing 20, are advantageously employed in form-locking zone region I to effect the force transfer in the region of the shear stress maximum 38 between the interior surface of the propelling cage sabot 12, which is provided with corresponding mating countergrooves, and the projectile body 14.

As shown in FIG. 1, the shear stress in front of and behind the local maximum 38 is substantially less over the length X of form-locking zone 16, so that annular grooves 18 can be employed here which are spaced from one another at a greater distance and/or have a lower groove height 46.

Figure 3:
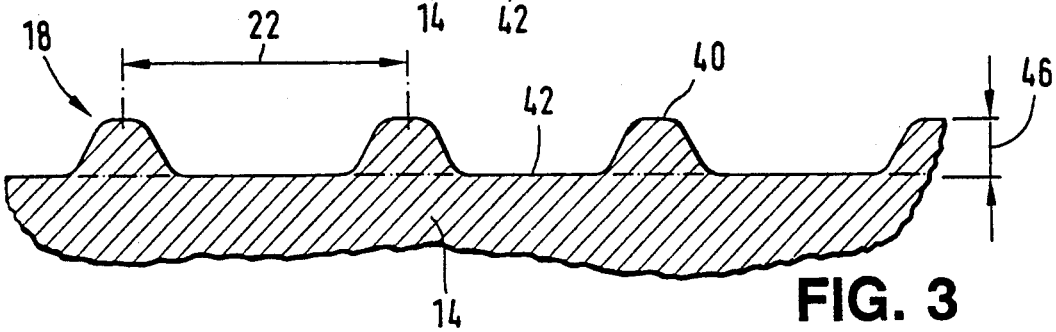
FIG. 3 is a longitudinal sectional view showing a second embodiment of a form-locking zone region between the kinetic energy projectile and the sabot of FIG. 1.

This is shown in FIG. 3 wherein the groove (or rib) spacing 22 is at least 1.5 times, and preferably twice as large as, the groove spacing 20 of FIG. 2. Moreover, the height 46 of the grooves 18′ and the depth of the groove bottom 42 may also be less than the height 44 in FIG. 2 so as to produce a force transfer which is adapted to the locally occurring shear stresses. This spacing 22 is advantageously suitable for the form-locking zone region II shown in FIG. 1 which is adjacent to and follows the form-locking zone region I in the direction toward projectile tip 34. However, form-locking zone region II need not necessarily extend over the entire remaining forward form-locking zone 16 up to the forward guide flange 24 since the shear stress $\tau$ continues to decrease in this region and thus means can be employed which effect a weaker form lock. This is possible, for example, in form-locking zone regions III and IV.

Region III is disposed behind the forward guide flange 24 at the front end of the form-locking zone 16 and has a groove spacing which is greater than that in form-locking zone region II.

Between form-locking zone region III and form-locking zone region II there is disposed a region IV which may have a groove spacing that is considerably greater than that present in regions I, II and III. Corresponding to the shear stress $\tau$ to be transferred, which in this region is negligible in practice, form-locking means, i.e. annular grooves 18, may also be omitted entirely in region IV, with sufficient firing strength being ensured nevertheless.

A region V is disposed between rear pressure flange 26 in the direction of guide mechanism 36, i.e., at the rear or tail of the form-locking zone 16. Due to radial forces acting on propelling cage sabot 12 as a result of the propelling gas pressure, form-locking means, e.g., annular grooves, may be omitted entirely in this region V and instead the force may be transmitted by friction. However, this force transfer is not possible in region IV which is disposed in the direction toward projectile tip 34 because the region IV is not charged with gas pressure during firing.

Figure 4:
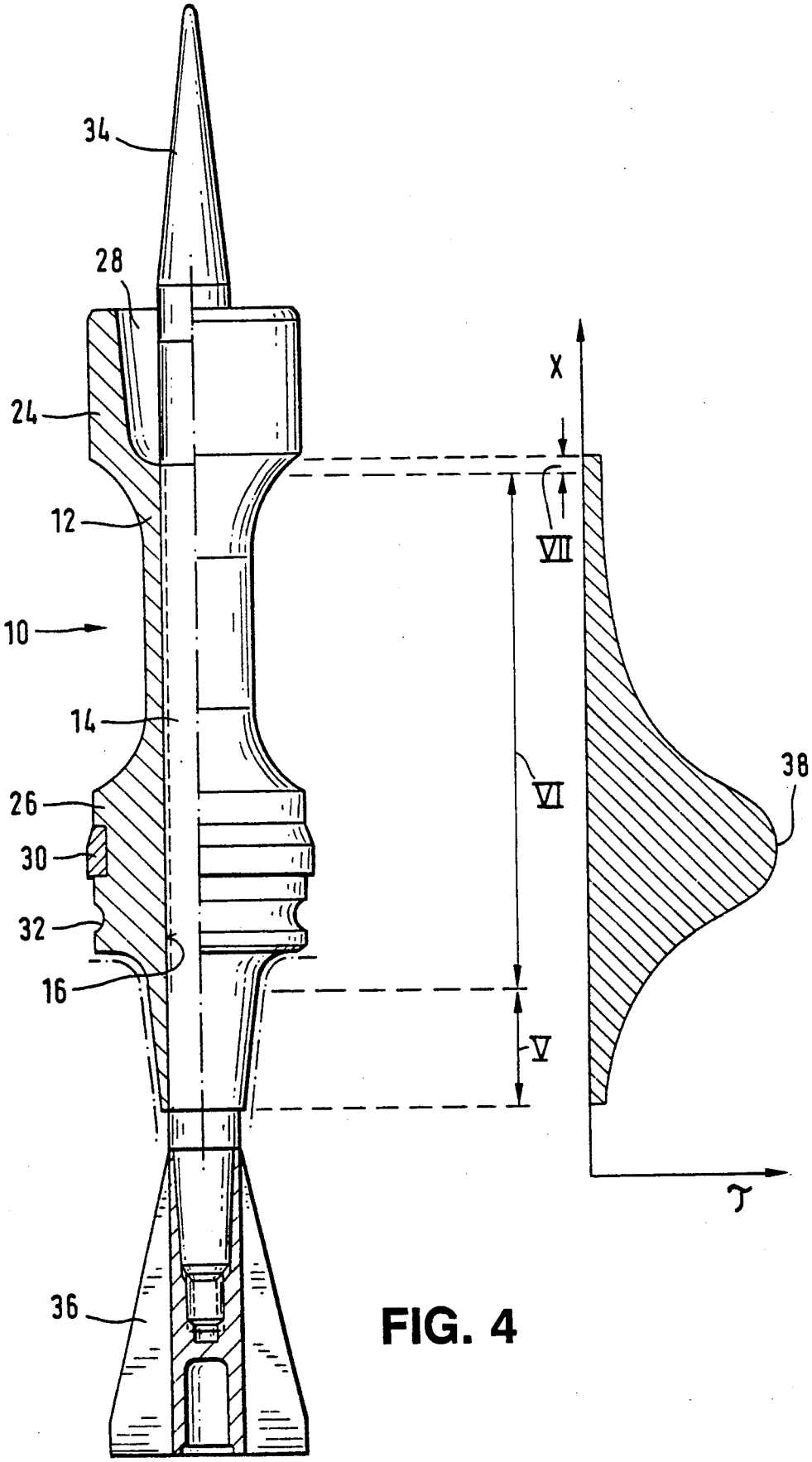
FIG. 4 is an elevational view, partially in section, showing a further subcaliber kinetic energy projectile according to the invention provided with a segmented discardable propelling cage sabot and the thrust curve of FIG. 1.

FIG. 4 shows a further arrangement of different form-locking zone regions V, VI, VII according to the invention. In region V behind rear pressure flange 26 the force may be transferred by friction as in FIG. 1. However, form-locking zone regions I, II, III and IV according to FIG. 1 are replaced by regions VI and VII. In this embodiment, region VII replaces form-locking zone region III of FIG. 1. However, regions VII extends over a shorter length than region III and is provided with annular grooves 18 as shown in FIG. 2 as they are also employed in form-locking zone region I. These annular grooves 18, arranged on a very short length region VII directly behind forward guide flange 24, serve the function of providing a desired break location for projectile body 14.

Firing tests have shown that penetrators i.e., projectile bodies, employing threads as form-locking means tend to uncontrollably break off particularly in the central region of the projectile body when they hit sloped multi-plate targets. This considerably reduces the final ballistic performance of a projectile as the resulting projectile halves are no longer able to penetrate the subsequent target plates.

By employing annular grooves 18 according to FIG. 2 for a form-locking zone region VII, a desired break location is applied to projectile body 14 directly behind the forward guide flange 24. Nevertheless, this desired break location serves to transfer thrust during firing and additionally causes a defined break-off on the first target plate. The remaining portion of the projectile body 14 still has sufficient mass after this break to be able to penetrate further target plates.

Figure 7:
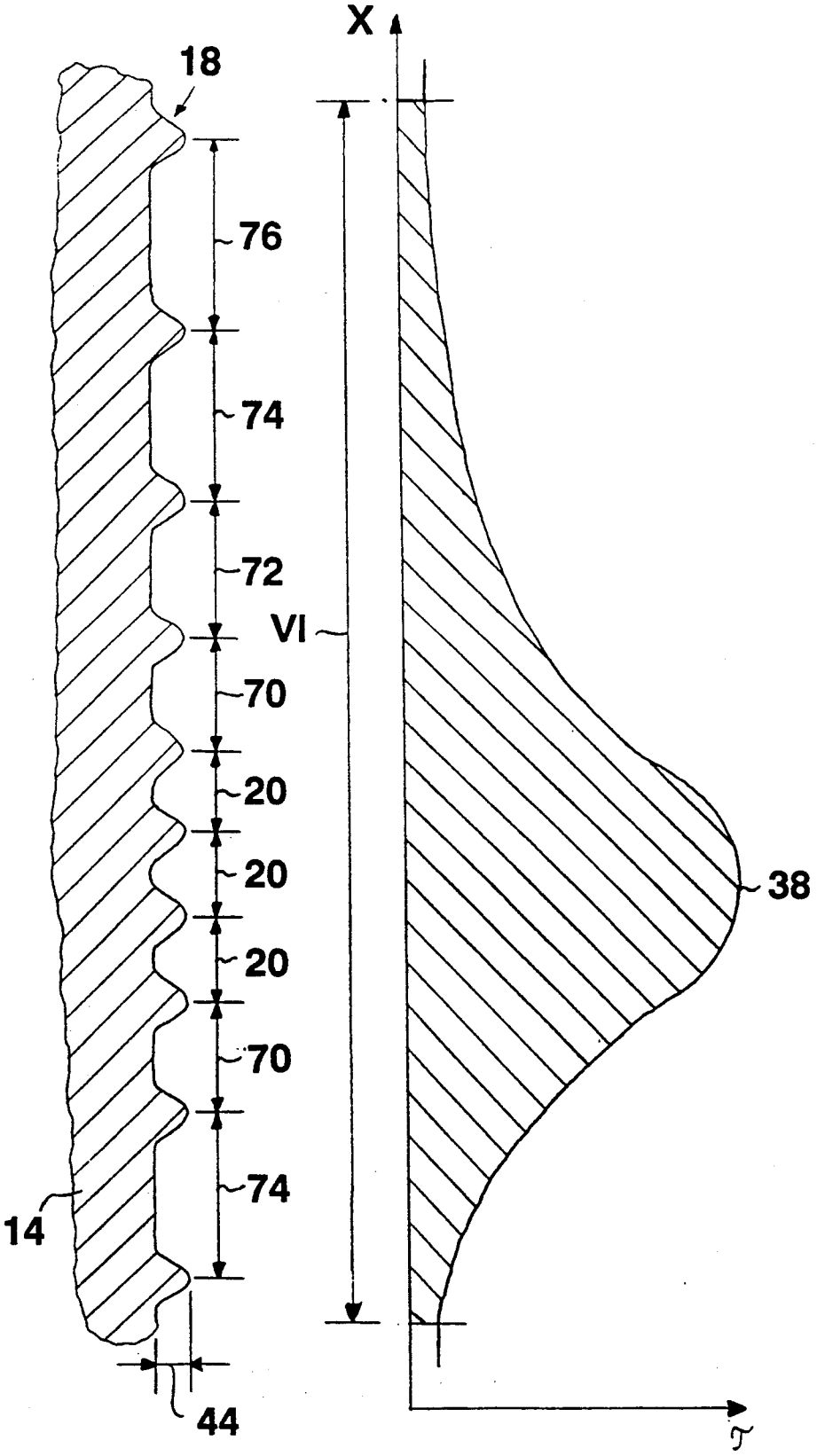
FIG. 7 is a longitudinal sectional view showing one of the form-locking zone regions of FIG. 4 and the thrust curve occurring over the length of this zone region.

In the embodiment of FIG. 4, form-locking zone region VI is distinguished by the fact that the annular grooves 18 are not uniformly spaced from one another in this region as, for example, in region I or II of FIG. 2. As shown in FIG. 7, in this region VI, the distance or spacing of adjacent annular grooves (or ribs) increases continuously from the region of the shear maximum 38 with decreasing shear stress $\tau$. Starting from region 38 where the shear stress has its maximum and in which annular grooves 18 are arranged at a groove spacing 20 according to FIG. 2, the spacing of neighboring annular grooves 18 arranged, for example, at distances 70, 72, 74 76 from one another, continuously increases with decreasing shear stress in the direction toward guide mechanism 36 up to region V and in the direction toward forward guide flange 24. In addition, groove height 44 may be reduced.

Figure 5:
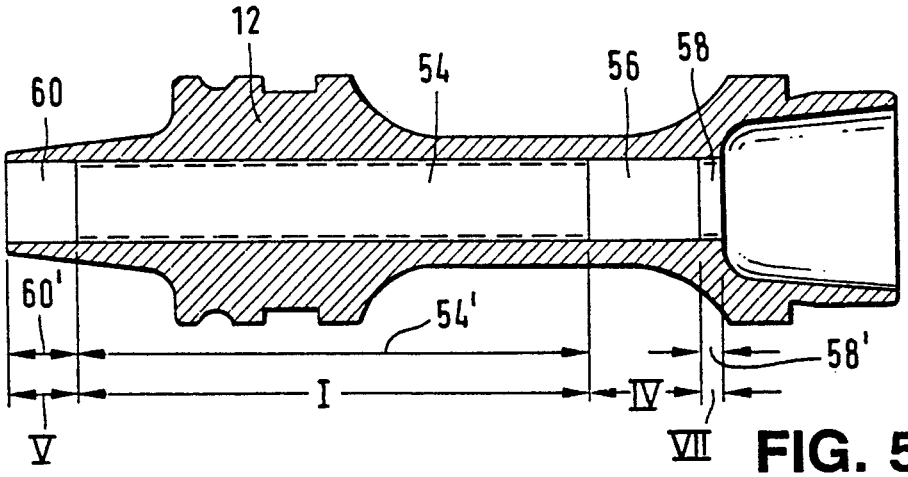
FIG. 5 is a longitudinal sectional view showing a first embodiment having different form-locking zone regions in a sabot according to FIG. 1.

FIG. 5 shows a first embodiment of an optimized propelling cage sabot 12 according to the present invention for the conventional calibers of automatic weapons. Form-locking zone region I, 54, i.e., the region of maximum thrust transmission, has a length 54' of about 60% of the total length of the propelling cage sabot. In this region 54, annular grooves 18 according to FIG. 2 are employed to effect the required form lock. For this embodiment, groove spacing 20 lies in a range from 1 to 3 mm with a groove height 44 of less than 1 mm.

The same groove spacing 20 and the same groove height 44 are employed in this embodiment in form-locking zone region VII, 58 disposed at the front behind the forward guide flange. However, this region 58 has only a length 58' such that two annular grooves 18 can be applied to the projectile body in this region to serve as desired break locations.

Between the two form-locking zone regions I and VII there is disposed a region IV, 56 which has no grooves. Behind form-locking zone region I, 54, a region V, 60 follows toward the tail of the form-locking zone. This region 60 lies in the gas pressure filled area of the projectile in which radially oriented forces also act on propelling cage sabot 12 so that in this region 60, which has a length 60' of about 7% of the total propelling cage sabot length, annular grooves 18 can also be omitted and the force transfer can occur by way of friction.

Figure 6:
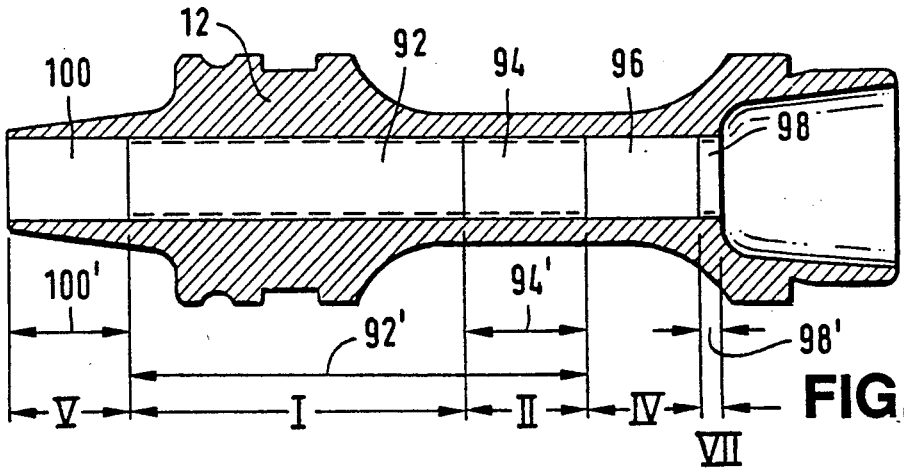
FIG. 6 is a longitudinal sectional view of a second embodiment having different form-locking zone regions in a sabot according to FIG. 1.

FIG. 6 shows a further optimization of the form-locking zone regions. Region V, 100, which is disposed at the tail end and is not provided with annular grooves, is larger in this embodiment than in FIG. 5 and has a length 100'. In this region 100 as well, the force can be transferred from propelling cage sabot 12 to the projectile body (not shown) by way of friction. The required form lock is effected by annular grooves 18 in a region 92 over a length 92'. In this embodiment, this region is optimized so that form-locking zone region 92 is subdivided into two regions I and II such that form-locking zone region I is provided with annular grooves 18 of FIG. 2 over a length which is approximately $\frac{3}{4}$ of the length 92'. In the direction toward the forward guide flange, region I is followed by form-locking zone region II, 94 which accordingly has a length 94' that is about $\frac{1}{4}$ of length 92'. In this form-locking zone region II, 94, the annular grooves 18 disclosed in FIG. 3 are sufficient to effect a transfer of force since here the thrust forces to be transferred are already lower than those in the region of the rear pressure flange 26. Compared to a groove height 44 produced by milling for form-locking zone region I, the groove height 46 in region II may also be made lower.

Form-locking zone II, 94 is followed, in the direction of the projectile tip (not shown), by regions IV, 96 and VII, 98. In region IV, 96, the shear stress has already decreased to such an extent that annular grooves 18 are no longer required for the transfer of force. Region VII, 98 here again has a length 98' which accommodates two annular grooves 18 as shown in FIG. 2 that are worked in as a desired break location and simultaneously serve as thrust transfer means during firing.

The embodiments disclosed in FIGS. 5 and 6 for conventional automatic weapon projectiles have already been tested and form-locking regions I, II and VII provided with annular grooves 18 as well as zones IV and V which are free of any form-lock have been found quite satisfactory during firing.

The force transfer means adapted to the thrust curve can also be transferred to corresponding longitudinal extents of projectiles 14 and sabots 12 of other subcaliber kinetic energy projectiles 10 to realize in such projectiles, by accurate design of the number of grooves and their local fixation, the lowest possible number of disturbance locations for the penetration process. Moreover, the application of grooves, which need not necessarily have a uniform, that is, continuous, round profile, but may also have a sawtooth shape or may be stepped or triangular, considerably simplifies the manufacturing process compared to the application of a conventional thread and the small number of grooves according to the invention leads to a reduction in the coefficient of air resistance $C_w$ of projectile body 14 so that larger target impact velocities can be realized with simultaneous improvement of the release behavior of sabot 12 from projectile body 14.

FIGS. 8*a*, 8*b*, 8*c* and 8*d* show different groove profiles which may be employed instead of the continuous round profile of FIG. 2 as the form-locking means in the zone 16.

Figure 8A:
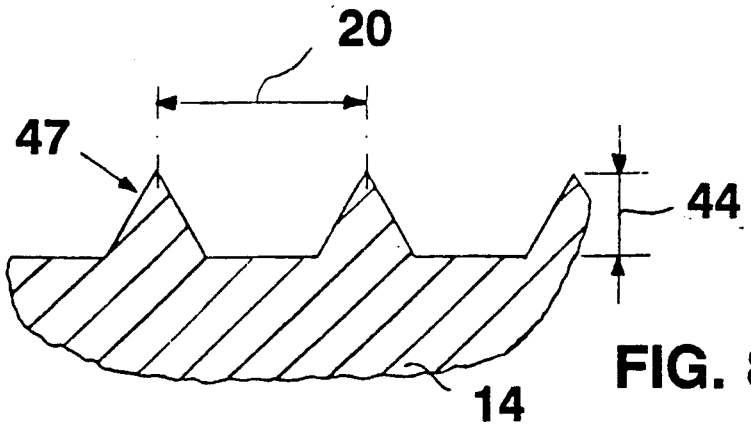
FIGS. 8*a*, 8*b*, 8*c*, 8*d* are longitudinal sectional views showing further embodiments of a form-locking zone region.
Figure 8B:
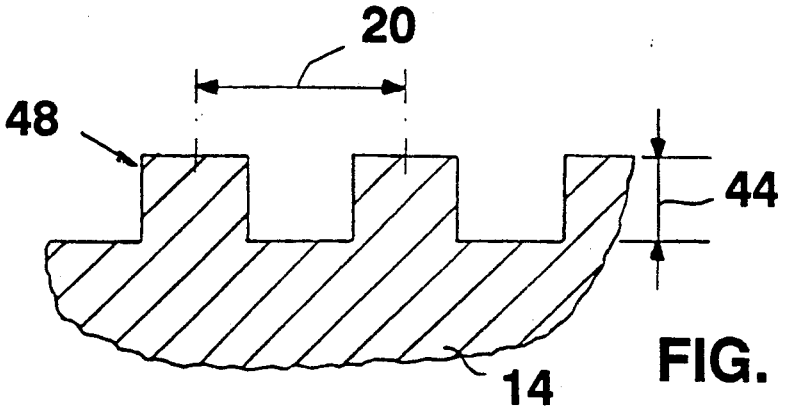

In the embodiment of FIG. 8*a*, the ribs 47 between the grooves have a triangular shape. Similar to those of FIG. 2, they are arranged on the projectile body 14 at a spacing 20 and have a height 44. FIG. 8*b* illustrates a stepped profile 48 seen in cross section.

Figure 8C:
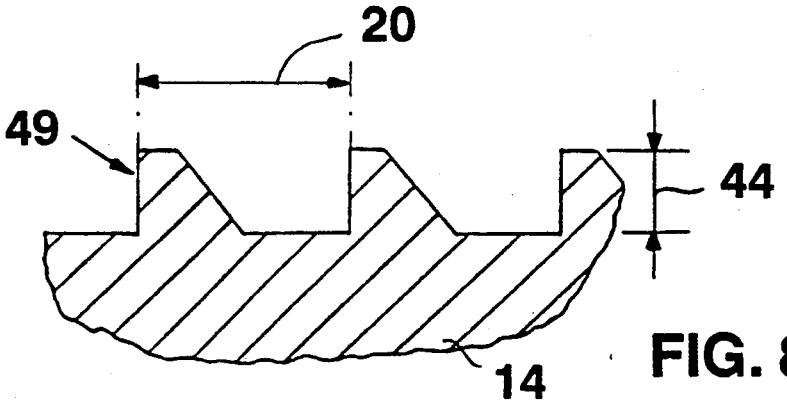
Figure 8D:
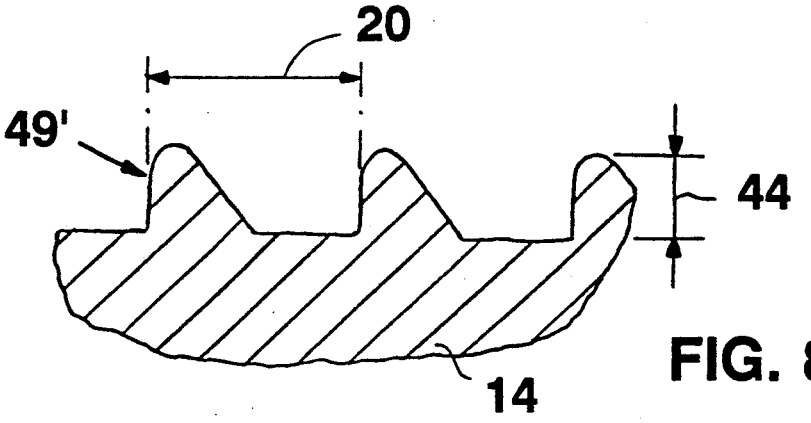

The ribs of FIGS. 8c and 8d have a sawtooth profile 49 or a rounded sawtooth profile 49.

In each case the inner surface of the not shown propelling cage sabot 12 is provided with corresponding recesses or grooves into which the ribs 47, 48, 49, 49' of the projectile body 14 engage.

Groove profiles as presented in FIGS. 8a to 8d having a groove spacing 20 can be employed as the form-locking means in the form-locking zone region I according to FIG. 1 Similarly they can be used in the form-locking zone II, with a spacing 22 according to FIG. 3 adapted to the shear stress $\tau$ occurring in this zone region.

The invention now being fully described, it will be apparent to one of ordinary skill in the art that any changes and modifications can be made thereto without departing from the spirit or scope of the invention as set forth herein.

What is claimed is:

1. In a projectile arrangement including a subcalibar projectile having a projectile body, a segmented discardable propelling cage sabot which surrounds at least a partial region of the length of said projectile body, and form locking means, disposed in a common form-locking zone extending along at least a portion of said region of said projectile body, for transferring acceleration forces from said propelling cage sabot to said projectile body, with said form-locking means including corresponding annular grooves on an exterior surface of said projectile body and on an interior surface of said propelling cage sabot; the improvement wherein: said common form-locking zone is subdivided into at least two form-locking zone regions; said annular grooves in said at least two form-locking zone regions each have a respectively different groove spacing which is related to the locally occurring shear stresses such that a minimum groove spacing is associated with a region of maximum shear stress; and, said groove spacing in a first of said form-locking zone regions is at least 1.5 times as large as said groove spacing in an adjacent second one of said form-locking zone regions.

2. A projectile arrangement as defined in claim 1 wherein: said propelling cage sabot is a dual flange sabot; said second of said form-locking zone regions extends at least over the longitudinal extent of a rear one of said flanges; and said first of said form-locking regions is disposed in front of said second of said form-locking zone regions.

3. A projectile arrangement as defined in claim 2, wherein said common form-locking zone is subdivided into at least three of said form-locking zone regions with said annular grooves in each of said three form-locking zone regions having respectively different groove spacings which are related to the locally occurring shear stresses.

4. A projectile arrangement as defined in claim 3 wherein the groove spacing in the third of said form-locking zone regions is greater than the groove spacing in said first of said form-locking zone regions and is disposed in front of said second of said form locking regions.

5. A projectile arrangement as defined in claim 4 wherein said third form-locking zone region extends to the front of said form-locking zone.

6. A projectile arrangement as defined in claim 1 wherein said form-locking zone includes at least one smooth region with no annular grooves.

7. A projectile arrangement as defined in claim 6 wherein said at least one smooth region is disposed at a tail end of said form-locking zone so that said acceleration forces are transferred between said projectile body and said propelling cage sabot by friction.

8. A projectile arrangement as defined in claim 1 wherein the height of said grooves and the depths of the associated groove bottoms are different in the respective said form-locking zone regions in relation to the locally occurring shear stresses.

9. A projectile arrangement as defined in claim 1 wherein said annular grooves, when seen in cross section have a profile which is one of a uniform and continuous rounded profile and a stepped profile.

10. A projectile arrangement as defined in claim 1 wherein ribs disposed between adjacent said annular grooves, when seen in cross section, have a profile which is one of a uniform and continuous rounded profile, a sawtooth profile, a rounded sawtooth profile, a stepped profile and a triangular profile.

11. A projectile arrangement as defined in claim 1 wherein said second one of said form-locking zone regions is disposed in the region of maximum shear stress.

12. A projectile arrangement as defined in claim 1 wherein said groove spacing in each respective of said form-locking zone regions is uniform.

13. In a projectile arrangement including a subcaliber projectile having a projectile body, a segmented discardable propelling cage sabot which surrounds at least a partial region of the length of said projectile body, and form locking means, disposed in a common form-locking zone extending along at least a portion of said region of said projectile body, for transferring acceleration forces from said propelling cage sabot to said projectile body, with said form-locking means including corresponding annular grooves on an exterior surface of said projectile body and on an interior surface of said propelling cage sabot; the improvement wherein: said common form-locking zone is subdivided into at least two form-locking zone regions; said annular grooves in said at least two form-locking zone regions each have a respectively different groove spacing which is related to the locally occurring shear stresses such that a minimum groove spacing is associated with a region of maximum shear stress; and, said groove spacing in each respective of said form-locking zone regions is uniform.

* * * * *